United States Patent [19]

Melgaard

[11] Patent Number: 4,515,561

[45] Date of Patent: May 7, 1985

[54] FIBER TREATMENT OVEN

[75] Inventor: Hans L. Melgaard, Minneapolis, Minn.

[73] Assignee: Despatch Industries, Inc., Minneapolis, Minn.

[21] Appl. No.: 473,076

[22] Filed: Mar. 7, 1983

[51] Int. Cl.[3] ..... F27B 9/00

[52] U.S. Cl. ..... 432/136; 432/144; 432/150; 432/190; 432/199; 126/21 A; 34/155; 219/391; 219/400

[58] Field of Search ..... 126/19 R, 21 R, 21 A; 34/155; 432/8, 59, 189, 150, 190, 136, 199, 144; 219/391, 400

[56] References Cited

U.S. PATENT DOCUMENTS

| | | | |
|---|---|---|---|
| 3,863,361 | 2/1975 | Gerhardt | 34/155 X |
| 4,039,278 | 8/1977 | Denholm | 126/21 A X |
| 4,197,659 | 4/1980 | Brinkhaus et al. | 34/155 |
| 4,354,549 | 10/1982 | Smith | 126/21 A X |

*Primary Examiner*—Margaret A. Focarino
*Attorney, Agent, or Firm*—James R. Haller

[57] ABSTRACT

A fiber treatment oven is disclosed in which hot gas is flowed parallel to and between fiber pathways within the oven to reduce deflection and breakage of fibers and to reduce end-to-end temperature variations in the oven. Hot gas is emitted centrally of the oven and flows toward ends of the oven. Preferably, an additional, generally tubular stream of hot gas is emitted centrally of the oven and generally surrounds and envelopes the fiber pathways to reduce side-to-side temperature variations.

15 Claims, 6 Drawing Figures

10
12
12.3
12.4
12.5
12.6
12.7
12.8
14
14.1
22
22.1
26
26.1
28
30
32
F
J
S
2
3
4

FIBER TREATMENT OVEN

FIELD OF THE INVENTION

The invention relates to ovens in general and, more particularly, to ovens designed for the heat treatment of continuous lengths of fibers or like materials.

BACKGROUND OF THE INVENTION

Fibers, and particularly organic fibers, often require heat treatment to develop certain properties. Rayon fibers or fibers of polyaerylonitrile, for example, may be converted to a conductive (carbonaceous) form through high-temperature treatment. Heat is also employed in the drying of coatings or dyes upon a variety of synthetic or natural fibers.

Various ovens have been developed for the heat treatment of fibers. Certain of such ovens consist primarily of one or more aligned ceramic tubes within which a tow or plurality of fibers to be heated may pass. Such ovens generally have no provision for air or gas flow. Other ovens commonly used for treating fibers from which reaction products of the heating step or solvents or the like may be liberated employ quantities of hot air or other gases in a cross-flow pattern for contact with the fibers. The fibers commonly are supported on rolls or spools, and such ovens may be provided with a device at one end for unrolling and feeding a length of fibers into the oven, and a take-up roller or spool at the other end of the oven for winding up the heated length of fibers. As a result, the fibers traverse a given path through the oven, care being taken to avoid breaking of the fibers through undue tension as the fibers are unwound at one end and wound up at the other end. Commonly, fibers traverse horizontal paths through such ovens and the fibers may be trained around pulleys or rollers at the oven ends so as to make several traverses of the oven interior. Air or other hot gases commonly are directed generally downwardly or at an angle to the fibers in the same manner in which hot gases are flowed or jetted onto webs of material such as adhesive tape when the latter are to be heat-dried or cured. Such drafts or jets of hot gas often cause the fibers themselves to deflect and often break within the oven housing. Further, because of the positioning of hot air input and exhaust vents, the temperature within such ovens often varies considerably, the temperature being generally lower near the fiber entrance and exit ports and also near the walls of the oven.

BRIEF DESCRIPTION OF THE INVENTION

The present invention provides a fiber treatment oven which provides substantially uniform temperatures throughout the path of fiber movement, and which avoids problems associated with deflecting, tangling or breaking of fibers due to the impingement of hot gases thereupon. "Fiber", as used herein refers to elongated, cord, thread or wire-like materials such as rayon, polyacrylonitrile, cotton and the like.

The invention in one embodiment comprises a fiber-treatment oven having housing means defining a plurality of spaced parallel fiber movement pathways for a plurality of fibers to traverse the interior of the housing, means providing hot gases to the housing, hot gas emission means carried within the housing and oriented to provide a plurality of streams of hot gas parallel to and between the fiber travel pathways, and hot gas exhaust means spaced from the emission means in the direction of fiber pathways and oriented to receive hot gases emitted parallel to and between the fiber pathways. In a preferred embodiment, the hot gas exhaust means comprises separate exhaust plenum means interior of the housing and adjacent its ends to receive hot gases therefrom, and exterior exhaust plenum means exterior of but communicating with the interior of the housing at its ends to receive hot gases therefrom, the housing being maintained at sufficient pressure to prevent drawing exterior, unheated gases within the interior plenum means, thereby providing, throughout the length of the fiber pathways within the interior of the housing, a substantially constant hot gas temperature. By virtue of directing the hot gases parallel to the fiber pathways, the normal travel of the fibers in a generally straight line throughout the oven interior is not significantly disturbed.

Desirably, the hot gas emission means is positioned intermediate the length of the fiber pathways and directs streams of hot gases in opposite directions therefrom but parallel to the fiber pathways. The hot gas emission means preferably further includes means directing streams or curtains of hot gases within but adjacent the inner walls of the housing to improve temperature uniformity within the housing, the curtains of hot gases forming, in effect, a tube or tunnel of moving hot gases about the fibers as the latter move along the fiber pathways.

DESCRIPTION OF THE PREFERRED EMBODIMENT

Figure 1:
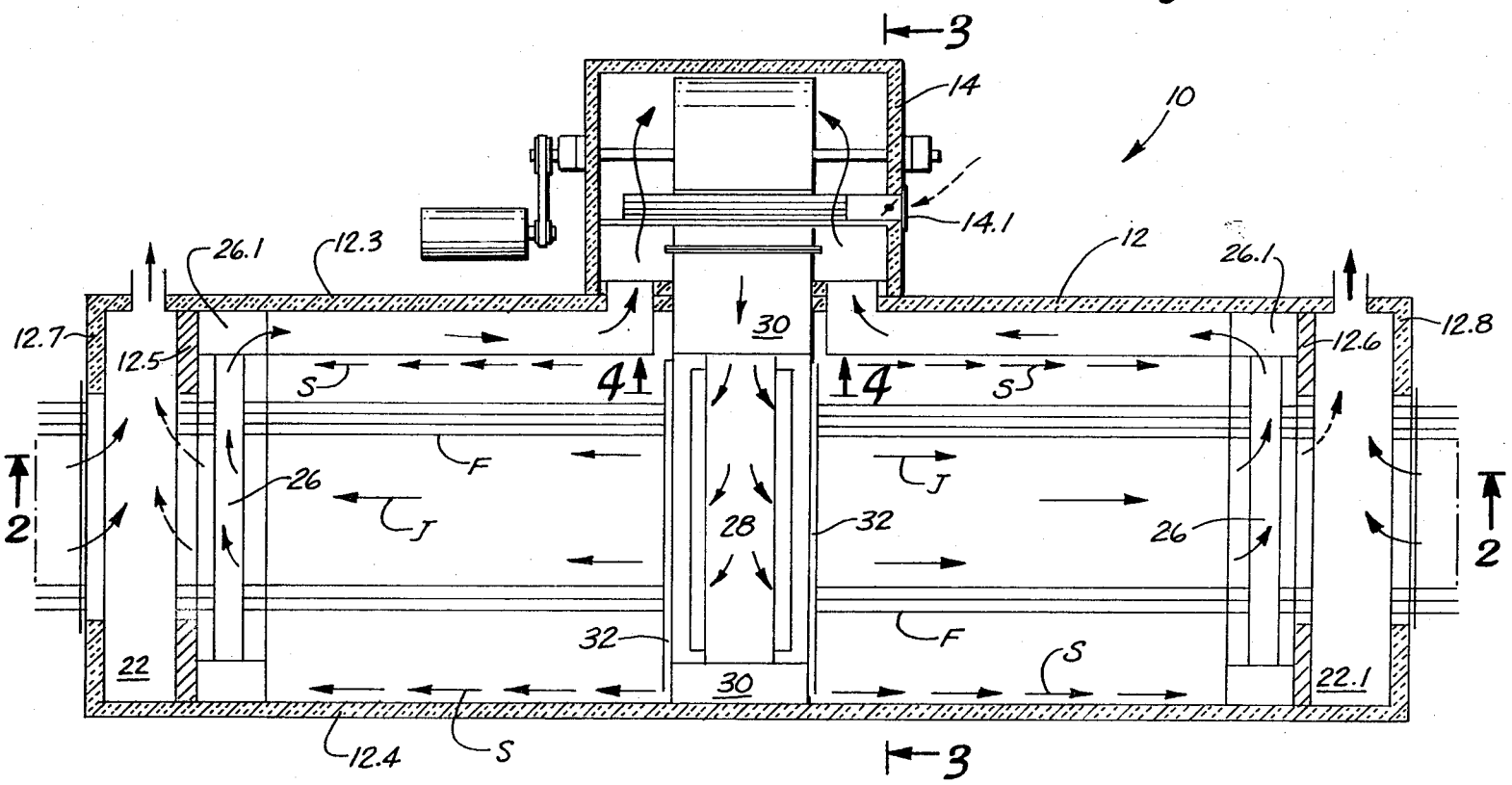
FIG. 1 is a cross-sectional, plan view of an oven of the invention, shown in partial cross section.
Figures 2, 6:
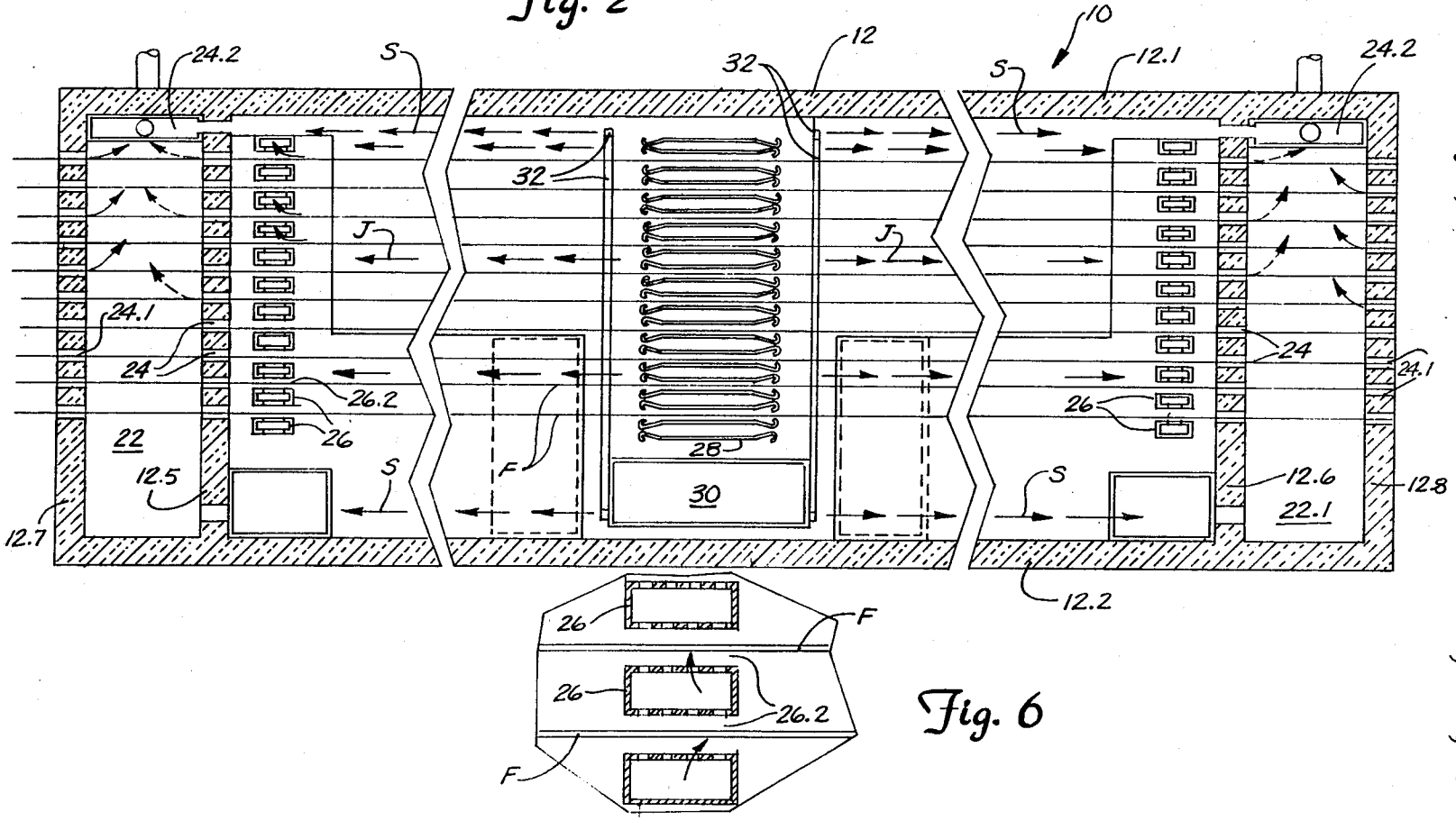
FIG. 2 is a cross-sectional, side view, partly broken away, along Line 2—2 of FIG. 1.
FIG. 6 is a cross-sectional, broken-away, largely schematic view showing a portion of the invention of FIGS. 1–4.
Figure 3:
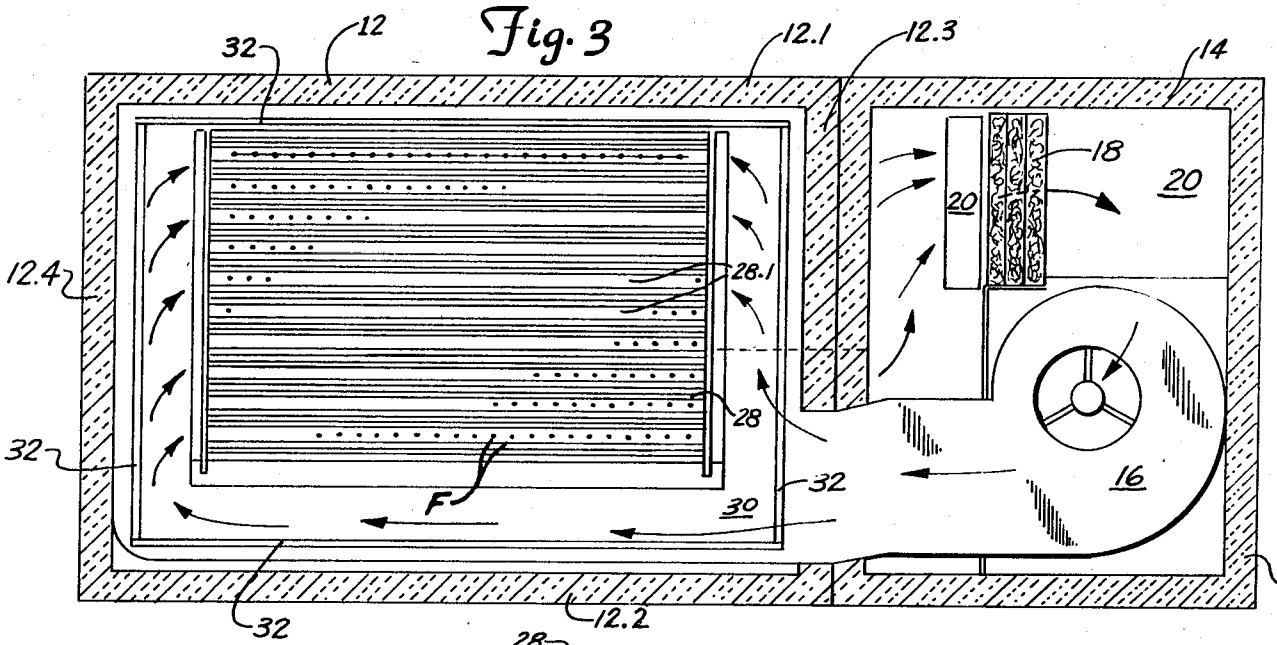
FIG. 3 is a cross-sectional view taken along Line 3—3 of FIG. 1.

With reference to FIGS. 1–3, an oven (10) is shown including a generally elongated housing (12) having top and bottom walls (12.1, 12.2), side walls (12.3, 12.4) and end walls (12.5, 12.6). Intermediate its length, an additional housing (14) is provided adjacent the side wall (12.3) the housing (14) including a motor-driven blower (16), a filter (18) for filtering exhaust gases, and a heater (shown schematically at (20) in FIG. 3) Make-up air or nitrogen or other gas to be heated may enter through the dampered part (14.1). It will be understood that the oven will be provided with temperature sensors withing its interior which, by known means, will control the temperature of hot air blown by the blower (16) into the oven interior. The heater (20) may be gas-fired or electric, as required, and may be of known design. It will also be understood that the oven may contain other monitoring equipment, as for measuring gas concentrations and the like, as are known in the art.

The top and side walls desirably are extended beyond the end walls (12.5, 12.6), and terminate in exterior walls (12.7, 12.8) to define exterior exhaust compartments (22,

22.1). The end walls (12.5, 12.6) are provided with a series of narrow, generally horizontal slots (24), and the exterior walls (12.7, 12.8) are provided with similar slots (24.1) for the same purpose.

Interior of the end walls (12.5, 12.6) and extending across the width of the oven adjacent the end walls are exhaust plenum means comprising a series of horizontally-extending, vertically stacked and spaced, perforated tubes (26), the tubes being generally rectangular in cross section, as shown in FIG. 6, and communicating, adjacent the side wall (12.3) with a return plenum (26.1) returning hot gases interiorly of the housing (14) to the blower housing (14). The tubes (26) are spaced from one another vertically to provide fiber-passage spaces (26.2), the latter spaces being horizontally aligned with the spaces (24) in the end walls and the spaces (24.1) in the exterior wall.

Figure 4:
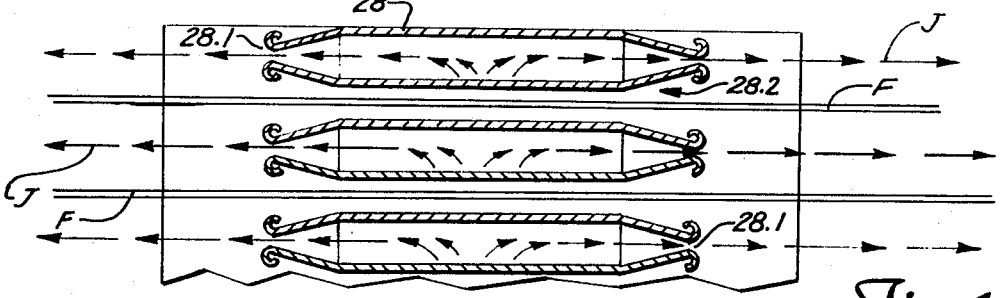
FIG. 4 is a cross-sectional view taken along Line 4—4 of FIG. 1.

Emission plenum means, characterized by a stack of individual, appropriately-shaped and generally horizontal tubes (28), are provided centrally in the oven intermediate its ends. Each tube (28) is generally rectangular in cross section and extends horizontally between but spaced from the side walls (12.3, 12.4), and each is provided with a generally-tapered nozzle portion (28.1) opening generally toward the fiber-passing spaces (24, 24.1) in the end and exterior walls. The openings (28.1) define hot gas directing nozzles and extend across the widths of the tubes (28). As shown in FIG. 4, the nozzles are so constructed and arranged as to supply streams of hot gas in the directions indicated by the arrows "J" in FIGS. 2 and 4. Each tube (28) communicates at one or both of its ends with a central feed plenum (30), which in turn communicates with the blower (16). The feed plenum (30) may be appropriately tapered or provided with adjustable slots (not shown) so as to render substantially uniform the velocity of hot gases issuing across the width of the nozzles (28.1).

The tubes (28) are spaced vertically from one another as shown in FIG. 4 to provide fiber-passing slots (28.2) therebetween, which slots are horizontally aligned with the slots (24, 24.1) in the end and exterior walls of the oven.

In the preferred embodiment depicted in the drawing, the emission plenum means (28) is positioned intermediate, and preferably is centered between the end walls (12.5), (12.6) and are provided nozzle portions (28.1) arranged to supply streams of hot gas in opposite directions but parallel to the fiber pathways, hot gases thus being directed toward both end walls and being exhausted through the exhaust plenum means. In this manner, the hot gases that thus are flowed to each end of the housing improve the end-to-end temperature uniformity within the housing and tend to further eliminate any flow of outside air or other unheated gases inwardly of the housing at its ends.

It has now also been found that side-to-side temperature variations within the housing may be minimized by employing nozzle means providing smooth sheets or curtains of air interior of and adjacent the top, bottom and side walls of the housing. Such means are typified by slots (32) formed about the periphery of the emission plenum adjacent the inner walls of the housing and facing each end wall, the slots (32) delivering streams of hot gases (designated "S") generally parallel to the inner housing wals and hence generating a generally tubular or tunnel-like stream of air adjacent the housing walls and extending parallel to and generally enveloping fibers in the fiber pathways as the fibers travel between the emission plenum means (30) and the exhaust plenum means (26) at each end of the housing. As shown in FIG. 3, the slots (32) desirably are formed substantially parallel to the housing walls. Of course, the slots (32) may be provided with nozzle-like apertures such as those shown at (28.1) in FIG. 4. Various other configurations, such as perforated tubes, may be employed, of course, to provide the streams of hot gases from the emission plenum. The housing end walls (12.5), (12.6) similarly may be provided with apertures such as shown at (32.1) adjacent the side, top and bottom walls of the housing to receive the streams "S" of hot gases passing parallel to such walls and to exhaust the same, it being understood that a portion of such gases may be exhausted through the interior exhaust plenum means (26).

In use, a hot gas such as air is supplied to the tubes (28) forming the emission plenum centrally in the oven, the hot gases issuing as streams or jets from the nozzles (28.1) in a generally horizontal direction toward the exhaust plenums (26), the velocity of hot gas and the configuration of the nozzles insuring generally horizontal hot gas flow. A predetermined quantity of the hot gases exits through the exhaust plenums (26) and are recycled through the heating means and blower to reenter the oven. A remaining portion of hot gases, due to the elevated pressure within the oven housing (12), passes outwardly of the end walls (12.5), is mixed with ambient air drawn inwardly through the ports (24.1), and is exhausted through ports (24.2) either to the atmosphere or to such scrubbing or other gas-cleansing means as may be appropriate. The pressure of hot gases within the housing (12) is such that the ports (24) in the end walls (12.5, 12.6) only pass hot gases outwardly, and ambient air is hence prevented from entering inwardly of the oven through the ports (24). As a result, the temperature of hot gases between the end walls (12.5, 12.6) is maintained substantially constant. Concurrently, the emission plenum emits sheets "s" of hot gas adjacent the top, bottom and side walls of the housing in directions parallel to the fiber pathways and toward the end walls of the housing, the sheets "s" of gas generally enveloping or surrounding the fiber pathways.

Fibers, shown as "F" in the drawing, pass from one end to the other of the oven through the paths defined by the horizontal slots in the exterior walls (12.7), the end walls (12.5) and between the tubes (28) forming the emission plenum means at the center of the oven. A wide variety of fiber unwind and windup equipment may be employed exteriorly of the exterior walls (12.7, 12.8), and such equipment is known to the art and need not be described here. A single length of fiber may be caused to make a number of traverses of the length of the oven, or a series of fibers may make but a single traverse of the oven length. Ovens of the type described may be used in end-to-end abutment to provide a series of zones, of different temperatures as desired, for long-term, high-temperature treatment of the fibers.

Figure 5:
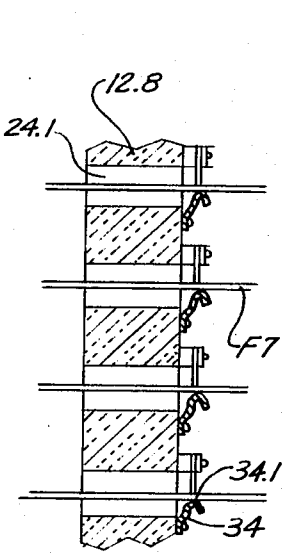
FIG. 5 is a broken-away, cross-sectional view showing a portion of the oven of FIGS. 1–4.

To reduce the flow rate of hot gas through the slots (24) in the end walls of the housing, or of outside air through the exterior end wall slots (24.1), a baffle means such as that shown in FIG. 5 may be employed. At the bottom of each horizontal slot (24.1) is mounted an upwardly extending plate (34) having a curved, smooth upper surface (34.1) upon which fibers may slide. At the top of each slot (24) may be mounted a downwardly extending, flexible flap (36) of silicone rubber or the like beneath which the fibers "F" may pass, the flap (36) and the plate (34) cooperating to narrow the width of the slot available for gas flow but not impeding the movement of fibers through the slot.

It will now be understood that the present invention enables fibers entering the oven from one end to be immediately subjected to heating at a uniform temperature by heated gases immediately upon entering the oven and throughout the passage of the fiber through the oven, the temperature being maintained substantially constant between the end walls (12.5, 12.6) and transversely of the fibers within the envelope of the hot gas emitted from the emission plenum. Further, although the velocity of hot gases within the oven may be quite large and the gases may be in turbulent flow, the fibers themselves, passing parallel to the streams of hot gas, are not subjected to significant transverse forces tending to disrupt the integrity of the fibers or to break them.

While a preferred embodiment of the present invention has been described, it should be understood that various changes, adaptations and modifications may be made therein without departing from the spirit of the invention and the scope of the appended claims.

What is claimed is:

1. A fiber-treatment oven for heating fibers by contact thereof with hot gas and comprising housing means defining a plurality of spaced, parallel pathways for a plurality of fibers to traverse the interior of the housing in the direction of and along said pathways, and means providing a source of hot gas; the oven being characterized by including hot gas emission means carried within the housing and oriented to provide a plurality of parallel streams of hot gas parallel to and between said fiber pathways longitudinally of the direction of fiber travel to gently contact said fibers; and hot gas exhaust means spaced from the emission means and oriented to receive hot gases emitted parallel to and between the fiber pathways.

2. The fiber-treatment oven of claim 1 wherein the hot gas exhaust means comprise separate exhaust plenum means interior of the housing to receive hot gases therefrom.

3. The fiber-treatment oven of claim 2, including exterior hot gas exhaust plenum means communicating with the interior of the housing to receive hot gases therefrom not exhausted through the exhaust plenum means interior of the housing.

4. The fiber-treatment oven of claim 2, including means maintaining the pressure within the housing at a value sufficient to prevent the intake of ambient air through the exhaust plenum means interior of the housing.

5. The fiber-treatment oven of claim 1 wherein the emission means comprises emission plenum means including a plurality of emission ducts constructed and arranged to direct streams of hot gas parallel to and along adjacent fiber pathways.

6. The fiber treatment oven of claim 1 wherein said hot gas emission means includes means emitting streams of hot gas parallel to and substantially enveloping the fiber pathways.

7. The fiber treatment oven of claim 1 wherein said hot gas emission means comprises emission plenum means disposed intermediate the length of said fiber pathways and adapted to emit streams of hot gas in opposite directions along and between said fiber pathways.

8. A fiber treatment oven for heating fibers by contact thereof with hot gas and comprising an elongated housing having top, bottom, side and end walls, the end walls having fiber passing openings therein defining spaced fiber pathways between the end walls for a plurality of fibers to traverse the housing, and a source of hot gas, the oven being characterized by including hot gas emission means communicating with said source and positioned intermediate the end walls, the emission means including means for directing hot gas parallel to, along and between said pathways toward said end walls longitudinally of the direction of fiber travel and means directing hot gas in streams adjacent inner surfaces of the top, bottom and side walls parallel to the fiber pathways and substantially enveloping the pathways.

9. The fiber treatment oven of claim 8 including hot gas exhaust means spaced from the hot gas emission means along the fiber pathways to receive and exhaust hot air emitted the emission means.

10. The fiber treatment oven of claim 9 wherein the hot gas emission means comprises a plurality of spaced hot gas emission ducts positioned between the fiber pathways and adapted to direct hot gas between and parallel to the fiber pathways.

11. The fiber treatment oven of claim 10 wherein said hot gas exhaust means comprises a plurality of spaced exhaust ducts positioned between the fiber pathways adjacent and within the respective end walls of the housing and generally aligned with respective emission ducts in the direction of the fiber pathways.

12. The fiber treatment oven of claim 11 further including exhaust compartment means exterior of the end walls of the housing but communicating with the housing interior through said fiber passing openings, for exhausting gas from the oven interior, and means maintaining said exhaust compartment means at a pressure below the interior housing pressure to prevent ingress of gas from the exhaust compartment into the housing interior.

13. A fiber treatment oven for treating fibers by contact thereof with hot gas and comprising housing means defining a plurality of spaced, parallel pathways for a plurality of fibers to traverse the interior of the housing in the direction of and along said pathways, and means providing a source of hot gas; the oven being characterized by including hot gas emission means carried within the housing and oriented to provide a plurality of streams of hot gas parallel to and between said fiber pathways in the direction of fiber travel; and hot gas exhaust means spaced from the emission means and oriented to receive hot gases emitted parallel to and between the fiber pathways, said hot gas exhaust means comprising separate exhaust plenum means interior or the housing, the oven including exterior hot gas exhaust plenum means communicating with the interior of the housing to receive hot gases therefrom not exhausted through the exhaust plenum means interiorly of the housing.

14. A fiber treatment oven for heating fibers by contact thereof with hot gas and comprising an elongated housing having top, bottom, side and end walls, the end walls having fiber passing openings therein defining spaced fiber pathways between the end walls for a plurality of fibers to traverse the housing between its end walls, and a source of hot gas, the oven being characterized by including hot gas emission means communicating with said source and positioned intermediate the end walls, the emission means comprising a plurality of spaced hot gas emission ducts positioned between the fiber pathways and adapted to direct hot gas between and parallel to the fiber pathways toward the end walls, hot gas exhaust means comprising a plurality of spaced exhaust ducts positioned between the fiber pathways adjacent and within the respective end walls of the housing and generally aligned with respect to ducts in the direction of the fiber pathways to receive and exhaust hot air emitted by the emission means, exhaust compartment means exterior of the end walls of the housing but communicating with the housing interior through said fiber passing openings for exhausting gas from the oven interior and means maintaining said exhaust compartment means at a pressure below the interior housing pressure to prevent ingress of gas from the exhaust compartment into the housing interior, and means directing hot gas in streams adjacent inner surfaces of the top, bottom and side walls parallel to the fiber pathways and substantially enveloping the pathways.

15. A fiber-treatment oven for treating fibers by contact thereof with hot gas and comprising an elongated housing having top, bottom, side and end walls, the end walls having fiber passing openings therein defining spaced fiber pathways between the end walls for a plurality of fibers to traverse the housing from one end wall to the other, and a source of hot gas, the oven being characterized by including hot gas emission means communicating with said source and positioned intermediate the end walls, the emission means comprising emission plenum means adapted to emit streams of hot gas in opposite directions longitudinally of the direction of fiber travel along and between said fiber pathways toward said respective end walls.

* * * * *